United States Patent [19]

Uralli et al.

[11] 3,933,281

[45] Jan. 20, 1976

[54] APPARATUS FOR VIBRATING BULK MATERIAL WITHIN A BIN OR TANK

[75] Inventors: Samil S. Uralli, Palos Verdes; Lemuel Huff, Paramount, both of Calif.

[73] Assignee: Johns-Manville Corporation, Denver, Colo.

[22] Filed: July 9, 1973

[21] Appl. No.: 377,682

Related U.S. Application Data

[63] Continuation of Ser. No. 110,941, Jan. 29, 1971.

[52] U.S. Cl. ..... 222/200; 222/234

[51] Int. Cl.[2] ..... B65G 65/70

[58] Field of Search ..... 302/58; 222/196, 196.1, 222/196.5, 198, 199, 200, 204, 233, 234, 235, 237, 243, 246, 416, 1, 196.2, 196.3, 196.4; 259/4, DIG. 41–DIG. 43

[56] References Cited

UNITED STATES PATENTS

| | | | |
|---|---|---|---|
| 465,108 | 12/1891 | Billing | 222/200 |
| 2,717,124 | 9/1955 | Fielden et al. | 302/58 X |
| 3,166,222 | 1/1965 | Schrader | 222/196 X |
| 3,435,993 | 4/1969 | Hunter | 222/200 X |

*Primary Examiner*—Robert B. Reeves
*Assistant Examiner*—Larry H. Martin
*Attorney, Agent, or Firm*—Robert M. Krone; Stephen C. Shear

[57] ABSTRACT

This invention relates to the use of a vibrating element (herein disclosed in the form of a ring) inside storage tanks or bins for aiding flow of powdered bulk material therefrom. The vibrating element is isolated from the walls of the storage tank or bin and vibrations are transmitted directly and principally to the material rather than indirectly through the walls.

5 Claims, 5 Drawing Figures

INVENTORS
S. S. URALLI
L. H. HUFF
By Joseph J. Kelly,
ATTORNEY

APPARATUS FOR VIBRATING BULK MATERIAL WITHIN A BIN OR TANK

This is a continuation of application Ser. No. 110,941, filed Jan. 29, 1971.

BACKGROUND OF THE INVENTION

Difficulties have long been encountered in removing finely divided powdery bulk material from storage bins. Particles pack or otherwise cling together in a manner which interfers with free flow. This is inherently caused by the basic characteristics of finely divided particles wherein they are attracted one to another causing packing which results in cavitation pockets where the material is being removed. Many methods are used to enhance flow of dry powdery material from a bin or tank, the most common being for a man to strike the outside of the bin adjacent its bottom or discharge with a heavy rubber-covered hammer. This method is relatively inefficient and quite expensive, aside from damage caused equipment such as bins and adjacent machinery. Another common method is to agitate the powdery bulk material by physically moving a stirring device through the powder. Another method is to place an electro-mechanical vibrator on the outside of the bin to shake or vibrate the bin in an effort to keep the material fluid and to prevent the formation of cavities. This method is relatively inefficient because the energy for vibrating the bulk material must be transmitted through heavy walls of the storage tank. A vast portion of the energy goes into vibrating the walls of the storage tank. These walls act as sounding boards and create noise to the annoyance of workmen in the area. Much of the vibrating energy is converted to sound.

The device disclosed herein has the advantages of mechanical stirring but by an efficient and generally enclosed mechanism. It amounts to a vibrating mechanism located internally of the bin and directly in contact with the material. It is substantially isolated from the walls of the tank or bin and the vibrations thereof are generally not transmitted to the tank or bin.

BRIEF SUMMARY OF THE INVENTION

It is an object of this invention to provide a vibrating device as an aid in causing dry, powdery bulk material to flow from a bin.

It is a further object of this invention to provide a vibrating device in a tank in a manner to directly agitate bulk material therein for maintaining it in a relatively fluid state for flow from the tank.

BRIEF DESCRIPTION OF THE INVENTION

This invention will be more fully understood and further objects and advantages thereof will become apparent when reference is made to the following detailed description of the preferred embodiment of the invention and the accompanying drawings in which.

DESCRIPTION OF THE PREFERRED EMBODIMENT

Figure 1:
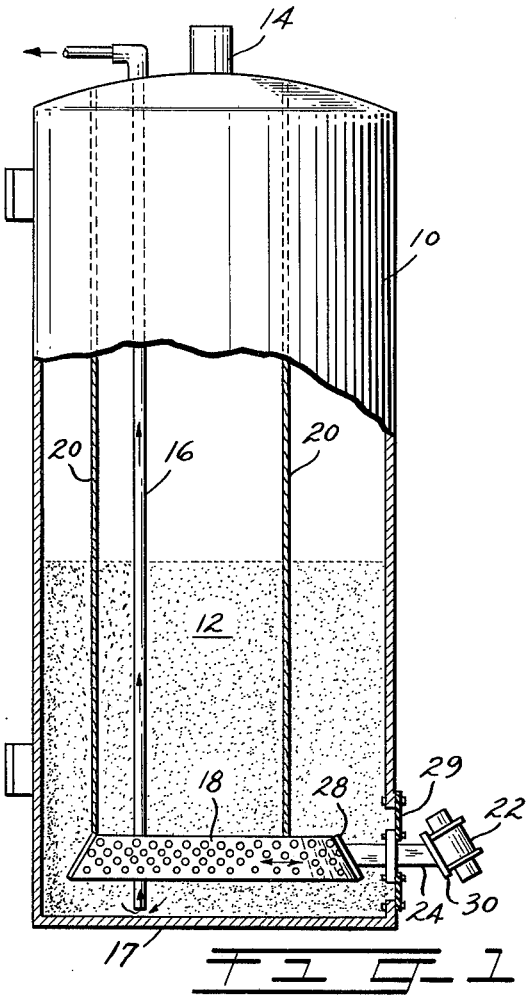
FIG. 1 is a side elevation of a bulk material storage bin partially in section to show the invention.

Referring to the drawing and particularly to FIG. 1 there is illustrated a storage tank or bin 10 for containing a normally dry powdery bulk material 12 in temporary storage. Materials handled in bins such as these vary considerably such as finely divided particles such as flower, sand, silica, lime, chemicals and coarser bulk materials capable of fluid-like flow. This type of bin is adapted to be filled through an inlet fitting 14 at the top. Bulk material is adapted to be removed through a suction line or pipe 16 which extends down through the bin and terminates near the bottom. The other end of the pipe is connected through a pump or the like (not shown) for discharging the bulk material at another location.

Figure 5:
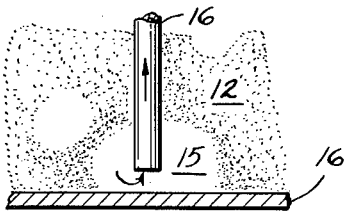
FIG. 5 is a sectional view showing cavitation resulting from packing of a powdery bulk material, thus hindering flow.

Under conditions wherein no external means are provided with bin 10 as an aid in causing flow of the bulk material out through pipe 16 under vacuum, the material would pack together and cavities such as 15 would occur in the vicinity of the entrance to pipe 16 and at other locations. This is illustrated in FIG. 5 and it is obvious that unless some manner is employed to cause the dry material to flow in and fill the cavity that no material can reach pipe 16.

According to the invention illustrated in FIG. 1, a ring 18 in the form of a frustum of a cone is suspended by cables 20 or otherwise isolated from the walls of the bin. The cables are preferably anchored near the top of bin 10. The ring is supported at a predetermined distance above the base wall 17 and entrance to pipe 16. The ring is normally spaced from sidewalls of the bin and totally immersed in material 12. It is adapted to be vibrated in a horizontal plane by generator 22 which may be one of many electro-mechanical devices on the market. The arrangement herein is such that its vibratory motion is transmitted substantially in its entirety to the ring on the inside of the bin. In this manner, practically no energy is consumed by the wall of the bin. All energy is initially applied to the bulk material. The motion from vibration generator 22 is transmitted by motion transmitting member 24 which communicates through an opening in a sidewall of the bin. A flexible curtain or baffle seals the space between the motion transmitting member and surrounding opening to contain material in the tank but permit vibratory motion to be transmitted therethrough.

Figure 4:
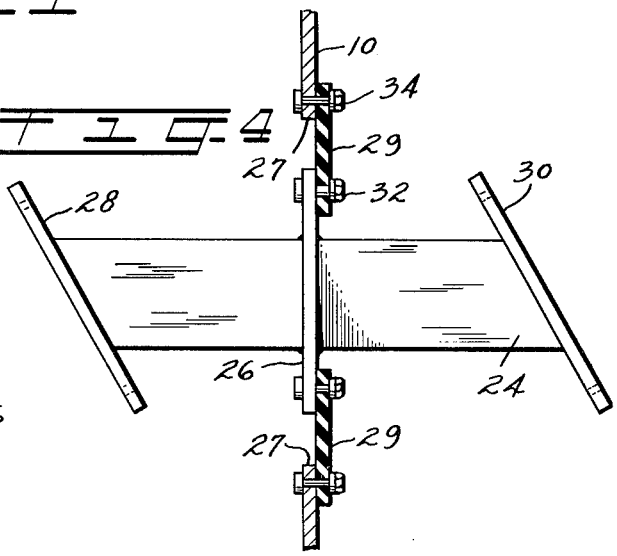
FIG. 4 is an enlarged view of the vibratory motion transmitting device.
Figure 3:
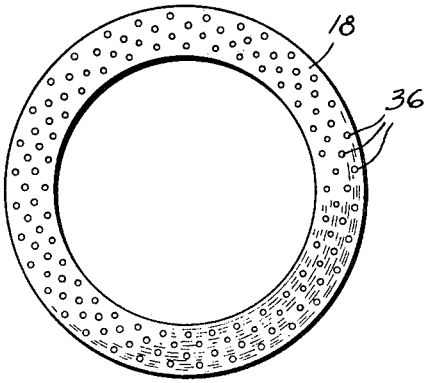
FIG. 3 is a plan view of the vibrating ring.

FIG. 4 illustrates the motion transmitting member in more detail. Its longitudinal body 24 may be formed from a length of pipe, a flange 26 is welded or otherwise secured intermediate its ends. Likewise flanges 28 and 30 are secured at its opposite ends. The member is adapted to communicate vibrations through an opening in the wall of the bin. Baffle or curtain 29 may be formed from rubber or any flexible sheet having supporting strength and being capable of being easily flexed so as not to transmit any substantial vibratory motion to the walls of the bin. As shown in FIG. 4 baffle 29, which is annularly shaped, carries flange 26 concentrically of the opening. Flange 26 and opening 27 are provided with holes therearound for receiving bolts 32 and 34 for attachment to the baffle. End flange 28 is adapted to be attached to ring 18 and end flange 30 is adapted to carry vibration generator 22.

Flanges 28 and 30 are shown angularly disposed with respect to member 24 for the purpose of accommodating frustal conical ring 18 and vibratory motion generator 22. Their angular disposition is not critical and may occupy other positions, depending upon the particular installation. The ring 18 as shown in several figures includes a plurality of holes 36 about its periphery. These holes normally extend transversely of the surface in which they are located. It will be appreciated that these holes and the angularly disposed sides of the ring present many facets on a vibratory surface so that a stirring action is imparted to the surrounding bulk material. Ring 18 of conical shape imparts a component of motion in several directions during its vibratory cycle. This shape has been found successful, though other bodies having projections and angularly disposed faces adjacent the material could likewise be used.

Vibrations applied directly to the bulk material over a relatively wide area, as by body 18, helps retain a homogeneous consistency and overcomes packing and cavitation.

From FIG. 1, it should be apparent that ring 18 is positioned in a substantially horizontal plane near base wall or bottom 17 of bin or container 10, bottom 17 being closed. As will be seen ring 18 includes a substantially centrally located opening therethrough and an inner and outer periphery which are angularly disposed with respect to the horizontal plane. It should also be apparent from FIG. 1 that base 17 is horizontal and that the side of the bin extends upwardly from the base and perpendicular therewith.

Figure 2:
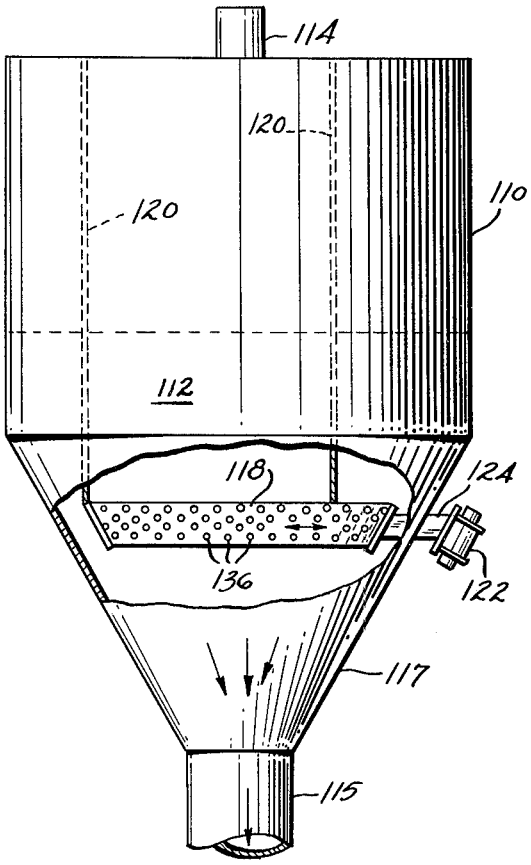
FIG. 2 is a side view partially in section similar to FIG. 1 but showing an alternate internal arrangement.

FIG. 2 illustrates another embodiment. In this figure the vibrating ring is located in another position. Bin 110 contains powdery bulk material 112 which is adapted to be collected therein through inlet 114. The material is adapted to be removed from the bin through outlet 115 at the bottom. Even with the steeply inclined sides 117 of the embodiment shown in FIG. 2 it is necessary to agitate the material therein so as to obtain proper flow. Vibrating ring 118 is supported by flexible cables 120 which are attached adjacent the top of the bin. The cables determine the vertical position of a vibrating ring and motion transmitting mechanism 124 determines its position laterally and with respect to the walls of the bin. The motion transmitting support 124 passes through the bin walls in such the same manner as shown and described in FIG. 4, and is generally totally immersed in the material.

As can be seen in either FIGS. 1 and 2, vibratory ring 18 or 118 is disposed above the outlet in effective proximity. Normally the ring is disposed some depth within the material to have the advantage of a head of pressure so as to force the material toward the outlet entrance. The vertical disposition of the ring best adapted for a particular installation can best be obtained by experimentation.

By the arrangement herein disclosed, a powdery, bulk material can be vibrated or agitated by mechanical means directly to the material without the necessity of transmitting shock waves through the walls of a bin 10 or 110. The walls of the bin no longer act as a sounding board for outward transmission of sound.

While the disclosure herein has been for use with a storage bin, it will be realized that this arrangement can be used advantageously in any chamber wherein the material inside is of a character tending to pack and cavitate in an area around where it is being removed.

What we claim is:

1. An apparatus for vibrating powdery bulk material in a container for aiding flow therefrom, said apparatus comprising:

a. a container closed at its bottom and having inlet means and outlet means for transiently storing powdery bulk material, said outlet means including a material suction conveyance pipe;

b. a closed-loop shaped vibratable member defining a substantially centrally located opening therethrough, said member being positioned within said container near the closed bottom of the container and in a non-contacting relationship therewith, said vibratable member being positioned substantially parallel with a horizontal plane passing through said container and including an outer periphery and inner periphery, both of which are angularly disposed with respect to said horizontal plane, said conveyance pipe extending into said container and terminating between said vibratable member and the closed bottom of said container, said opening defined by said member being exposed to the material in said container so as to allow material in said container to pass through said opening;

c. means for supporting said vibratable member within said container; and d. means for vibrating said vibratable member.

2. An apparatus according to claim 1 whereby said vibratable member is in the form of a frustum of a cone, the inner and outer periphery of which taper downwardly and outwardly with respect to the axis of said member.

3. An apparatus according to claim 1 wherein said vibratable member includes a plurality of holes about its periphery.

4. An apparatus according to claim 1 wherein said material conveyance pipe extends into said container through the opening defined by said member and terminates on the other side thereof.

5. An apparatus according to claim 1 wherein said closed bottom of said container is substantially parallel to said horizontal plane and wherein said container includes side wall means extending upwardly from said closed bottom, at least that portion of said side wall means between said horizontal plane and said bottom being perpendicular with said closed bottom.

* * * * *